US010051353B2

(12) United States Patent
Robison et al.

(10) Patent No.: US 10,051,353 B2
(45) Date of Patent: Aug. 14, 2018

(54) TELECOMMUNICATIONS AUDIO ENDPOINTS

(71) Applicant: Cisco Technology, Inc., San Jose, CA (US)

(72) Inventors: David William Nolan Robison, Campbell, CA (US); Kevin Lee Hughes, Frisco, TX (US); Feng Bao, Sunnyvale, CA (US); Stephen Lee Ijams, San Jose, CA (US); Victor Manuel Sanchez, San Jose, CA (US); David M. Sanguinet, San Jose, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 15/454,212

(22) Filed: Mar. 9, 2017

(65) Prior Publication Data

US 2018/0167706 A1 Jun. 14, 2018

Related U.S. Application Data

(60) Provisional application No. 62/433,375, filed on Dec. 13, 2016.

(51) Int. Cl.
*H04R 27/00* (2006.01)
*H04R 1/02* (2006.01)
(Continued)

(52) U.S. Cl.
CPC ..... *H04R 1/026* (2013.01); *H04R 1/2846* (2013.01); *H04R 1/2892* (2013.01); *H04R 1/323* (2013.01); *H04R 1/406* (2013.01); *H04R 19/016* (2013.01)

(58) Field of Classification Search
CPC ..... H04R 27/00; H04R 1/406; H04R 3/005; H04R 1/02; H04R 2201/401;
(Continued)

(56) References Cited

U.S. PATENT DOCUMENTS 6,072,522 A * 6/2000 Ippolito ..... H04N 7/15 348/14.1
7,519,175 B2 4/2009 Suzuki et al.
(Continued)

FOREIGN PATENT DOCUMENTS

EP 0297975 B1 1/1989

OTHER PUBLICATIONS

Holger Stoltze, "Revolabs FLX™—The Conference Phone, Evolved", Revolabs, Inc., www.revolabs.com, Feb. 9, 2012, 15 pages.

*Primary Examiner* — Melur Ramakrishnaiah
(74) *Attorney, Agent, or Firm* — Edell, Shapiro & Finnan, LLC

(57) ABSTRACT

Presented herein is an audio endpoint for telecommunication operations, sometimes referred to herein as a "telecommunications audio endpoint" or, more, simply as an "audio endpoint." According to at least one example, the audio endpoint presented herein includes a base, a speaker, a speaker waveguide, a microphone waveguide, and two or more microphones. The base is configured to engage a support surface (i.e., a table) and the speaker is configured to emit sounds (i.e., fire) in a direction of the base. The speaker waveguide is disposed between the speaker and the microphone waveguide, while the microphone waveguide is disposed between the speaker waveguide and the base. The two or more microphones are disposed within the microphone waveguide and are proximate to the base. In general,
(Continued)

the speaker waveguide is configured to guide sounds output by the speaker in general radially (outward) directions.

20 Claims, 18 Drawing Sheets

(51) Int. Cl.

| | |
|---|---|
| ***H04R 1/40*** | (2006.01) |
| ***H04R 1/32*** | (2006.01) |
| ***H04R 1/28*** | (2006.01) |
| *H04R 19/01* | (2006.01) |

(58) Field of Classification Search
CPC ..... H04R 2227/001; H04R 2430/25; H04R 2410/01; H04R 2499/11; H04R 2201/403
USPC ..... 381/66, 92, 77, 363, 397; 379/202.01
See application file for complete search history.

(56) References Cited

U.S. PATENT DOCUMENTS

| | | | | |
|---|---|---|---|---|
| 7,925,004 | B2 | 4/2011 | Hodges et al. | |
| 8,817,971 | B2 | 8/2014 | Shida et al. | |
| 9,113,264 | B2 | 8/2015 | Frater | |
| 2011/0194719 | A1* | 8/2011 | Frater | H04R 27/00 381/332 |
| 2016/0101499 | A1* | 4/2016 | Sventek | B32B 3/02 428/137 |

* cited by examiner

TELECOMMUNICATIONS AUDIO ENDPOINTS

PRIORITY CLAIM

This application claims priority to U.S. Provisional Patent Application No. 62/433,375, filed Dec. 13, 2016, the entirety of which is incorporated herein by reference.

TECHNICAL FIELD

The present disclosure relates to telecommunications audio endpoints.

BACKGROUND

Audio endpoints, such as conference phones, electronic personal/home assistants, hands-free/smart speakers (i.e., speakers with voice controls), and other devices that include a speaker and one or more microphone(s), typically separate the microphone(s) and the speaker either horizontally/laterally or vertically. When the microphone(s) and speaker are vertically separated, combing effects (due to harmonic cancellations) may significantly reduce the sound quality of the speaker and/or prevent the microphone(s) from picking up at least some sound. Consequently, devices with vertical separation between the speaker and the microphone(s) (i.e., electronic personal assistants) may not meet telecommunication standards. That is, devices with vertical separation between the speaker and the microphone(s) may be unacceptable for telecommunication purposes, even if these devices are still acceptable for personal/home assistant purposes. In some instances, devices with vertical separation may implement acoustic echo canceling ("AEC") algorithms in an attempt to achieve acceptable echo quality. However, these algorithms may not be effective in all conditions. For example, some AEC algorithms require low distortion and low sound pressure levels to be received by the microphone(s) in order to provide full-duplex communication.

By comparison, horizontal separation between microphone(s) and a speaker typically prevents (or diminishes) the impact of acoustic coupling between the speaker and the microphone(s) and allows an audio device to operate within parameters specified by telecommunication standards. Consequently, audio endpoints for telecommunication operations (i.e., conference phones) typically provide horizontal separation between a speaker and the microphone(s). For example, some conference phones provide approximately 15 cm of horizontal separation between a speaker and a microphone. However, this horizontal separation creates a large horizontal footprint, causing many conference phones to have a footprint that is significantly larger than desktop phones or other such audio devices (i.e., traditional conference phones are 20-30 cm in diameter).

DESCRIPTION OF EXAMPLE EMBODIMENTS

Overview

Figure 1:
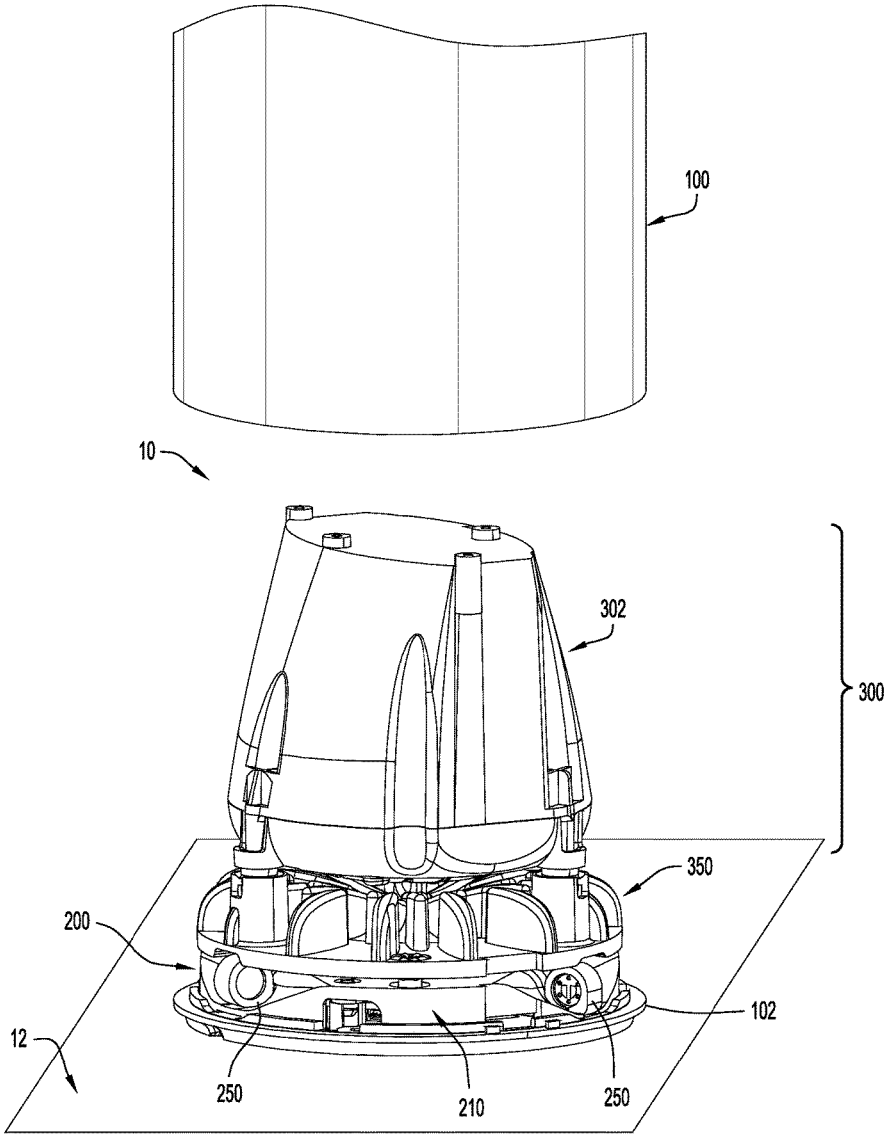
FIGS. 1 and 2 are diagrams illustrating perspective views of an audio endpoint for telecommunication operations, in accordance with example embodiments presented herein.

Presented herein is an audio endpoint for telecommunication operations, sometimes referred to herein as a "telecommunications audio endpoint" or, more simply, as an "audio endpoint." According to at least one embodiment, the audio endpoint presented herein includes a base, a speaker, a speaker waveguide, a microphone waveguide, and two or more microphones. The base is configured to engage a support surface (i.e., a table) and the speaker is configured to emit sounds (i.e., fire) in a direction of the base. The speaker waveguide is disposed between the speaker and the microphone waveguide, while the microphone waveguide is disposed between the speaker waveguide and the base. The two or more microphones are disposed within the microphone waveguide and are proximate to the base. The speaker waveguide is generally configured to guide sounds output by the speaker in radially (outward) directions. In at least some of these embodiments, a gap is disposed between the speaker waveguide and the microphone waveguide which allows low frequency pressure to pass through the endpoint between the speaker waveguide and the microphone waveguide. Additionally or alternatively, the two or more microphones may each be oriented to receive sound in a direction perpendicular to at least one of the radially outward directions in which the speaker waveguide guides the sound output by the speaker.

According to certain embodiments, an audio endpoint includes a base plate, a speaker assembly, and a microphone assembly. The base plate is configured to support the audio endpoint on a support surface and the speaker assembly includes a speaker configured to emit sounds (i.e., fire) towards the base plate. The speaker assembly also includes a speaker waveguide disposed between the speaker and the base plate. The microphone assembly is disposed between the speaker assembly and the baseplate and is vibrationally and acoustically isolated from the speaker assembly. In at least some of these embodiments, the speaker waveguide includes interleaved sets of fins configured to smooth pressure from a center of the speaker waveguide outward, over a broad frequency range, as the sound emitted from the speaker propagates radially outward.

In still further embodiments, an audio endpoint presented herein includes a base plate, a speaker assembly including a speaker that fires towards the base plate, and a microphone assembly. The base plate is configured to support the audio endpoint on a support surface. The microphone assembly includes a plurality of microphones and a microphone waveguide that is disposed between the speaker and the baseplate. The microphone waveguide includes a plurality of graduated microphone pockets and each of the plurality of microphones is positioned at the bottom of one of the graduated microphone pockets. Each microphone is positioned in an orientation that allows each of the plurality of microphones to pick up sound from directions that are approximately tangent to an outer circumference of the microphone waveguide. In at least some of these embodiments, the graduated microphone pockets create impedance pockets on opposite sides of each of the plurality of microphones.

Example Embodiments

Presented herein are audio endpoints that have a small-form factor, but are also capable of providing full duplicity, thereby making the audio endpoints suitable for telecommunication operations. In one arrangement, the audio endpoint includes a horizontal footprint of approximately 10 cm in diameter, which is small compared to traditional conference phones (i.e., one-half or one-third the size of traditional conference phones). For example, many conference room phones have footprints on the order of approximately 25 cm by approximately 25 cm (+/−5 cm) in order to maintain sufficient physical horizontal separation between the speaker and microphone. This large physical separation in conventional devices decreases the Sound Pressure Level (SPL) received by the microphone, which is a requirement for full-duplex communication. By comparison, the audio endpoint presented herein is not limited by horizontal speaker-to-microphone distances.

In order to provide the small-form factor and meet telecommunication standards, the audio endpoints presented herein include microphones, such as bidirectional microphones, disposed around the perimeter of the audio endpoint, at locations that are proximate to a support surface on which the audio endpoint is resting (i.e., close to a table surface, desk surface, etc.). The microphones are radially spaced, at equidistant intervals, adjacent to (i.e., proximate to, but inset from) an outer circumference/edge of the endpoint and are generally oriented to pick up sound in a direction that is substantially tangent to the circumference of the endpoint. Put another way, the microphones are generally positioned and oriented to pick up sound in a direction that is perpendicular to at least one of the directions in which sound is emitted from the speaker, which is generally emitted radially (i.e., 360 degrees) from the endpoint. This is accomplished, in part, by orienting the microphones perpendicularly to both a central vertical axis of the endpoint and the speaker (such that the null of each microphone is pointed at the speaker). Thus, when the microphones are bi-directional microphones, such as bi-directional electret condenser microphones (ECMs), the lobes or faces of the bi-directional microphones are aligned with a reference circle and/or reference annulus centered on a vertical axis of the audio endpoint (with the faces or lobes of each microphone perpendicular to interior and exterior walls of the annulus). Moreover, the microphones are positioned within microphone pockets that are included in a microphone waveguide that create impedance pockets on opposite sides of each microphone.

The microphones are also vibrationally and acoustically isolated from a speaker included in the audio endpoint due, at least in part, to the speaker being configured to fire (i.e., emit sound) downwards into a speaker waveguide that is disposed between the microphones and the speaker. The speaker waveguide is configured to redirect sound emitted by the speaker, as well as pressure generated by the speaker, in a radial direction out of the audio endpoint and away from the microphones. That is, the speaker waveguide guides pressure and sound radially to an outlet.

The configuration of the presented audio endpoints significantly increase speaker-to-microphone coupling rejection, thereby allowing for full-duplex communication in a device with a small footprint. The configurations also allow the microphones to be positioned close to the support surface (i.e., table), which provides maximum high frequency extension and fidelity without sacrificing echo cancelling performance. In other words, the configurations of the audio endpoints presented herein significantly increase audio quality for the speaker and the microphones.

Now turning to the Figures, it is to be understood that terms such as "left," "right," "top," "bottom," "front," "rear," "side," "height," "length," "width," "upper," "lower," "interior," "exterior," "inner," "outer," "forward," "rearward," "upwards," "downwards," and the like as may be used herein, merely describe points or portions of reference and do not limit the examples presented to any particular orientation or configuration. Further, terms such as "first," "second," "third," etc., merely identify one of a number of portions, components and/or points of reference as disclosed herein, and do not limit the examples presented herein to any particular configuration or orientation.

Figure 2:
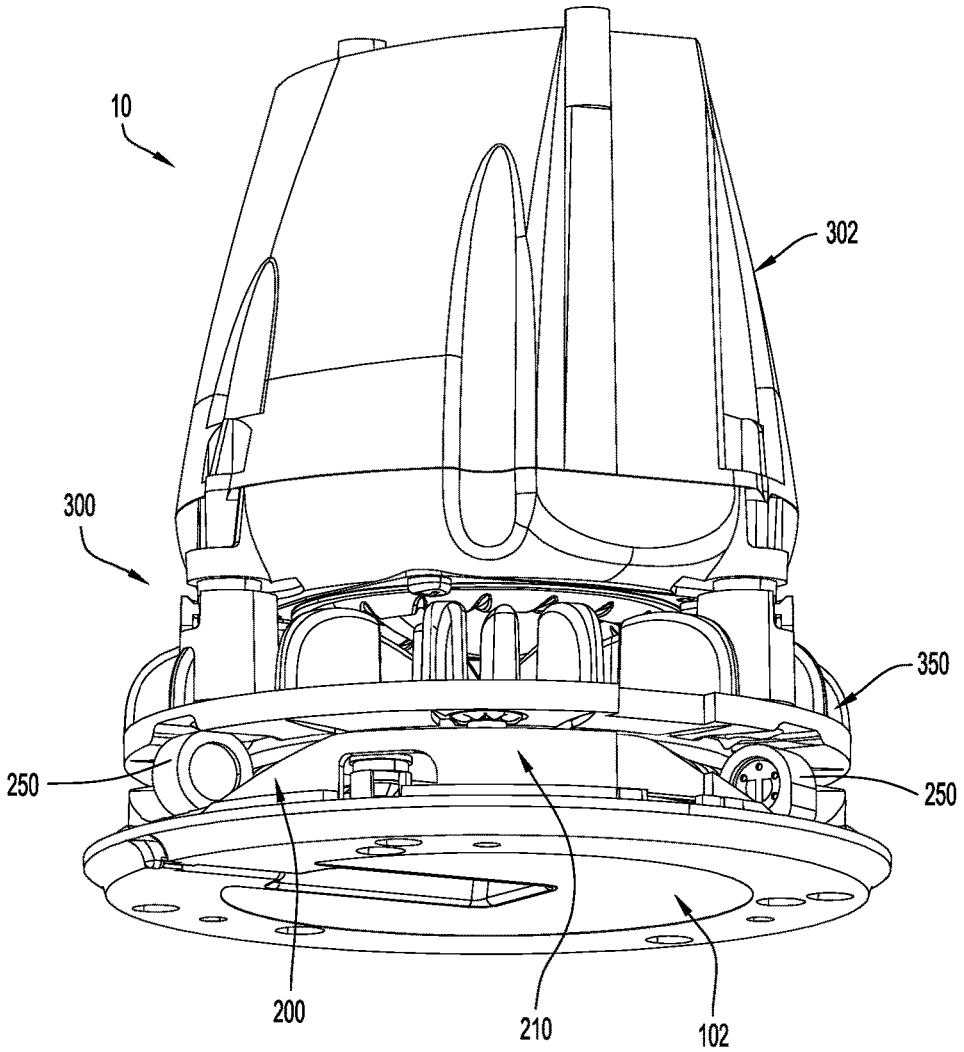
Figure 3:
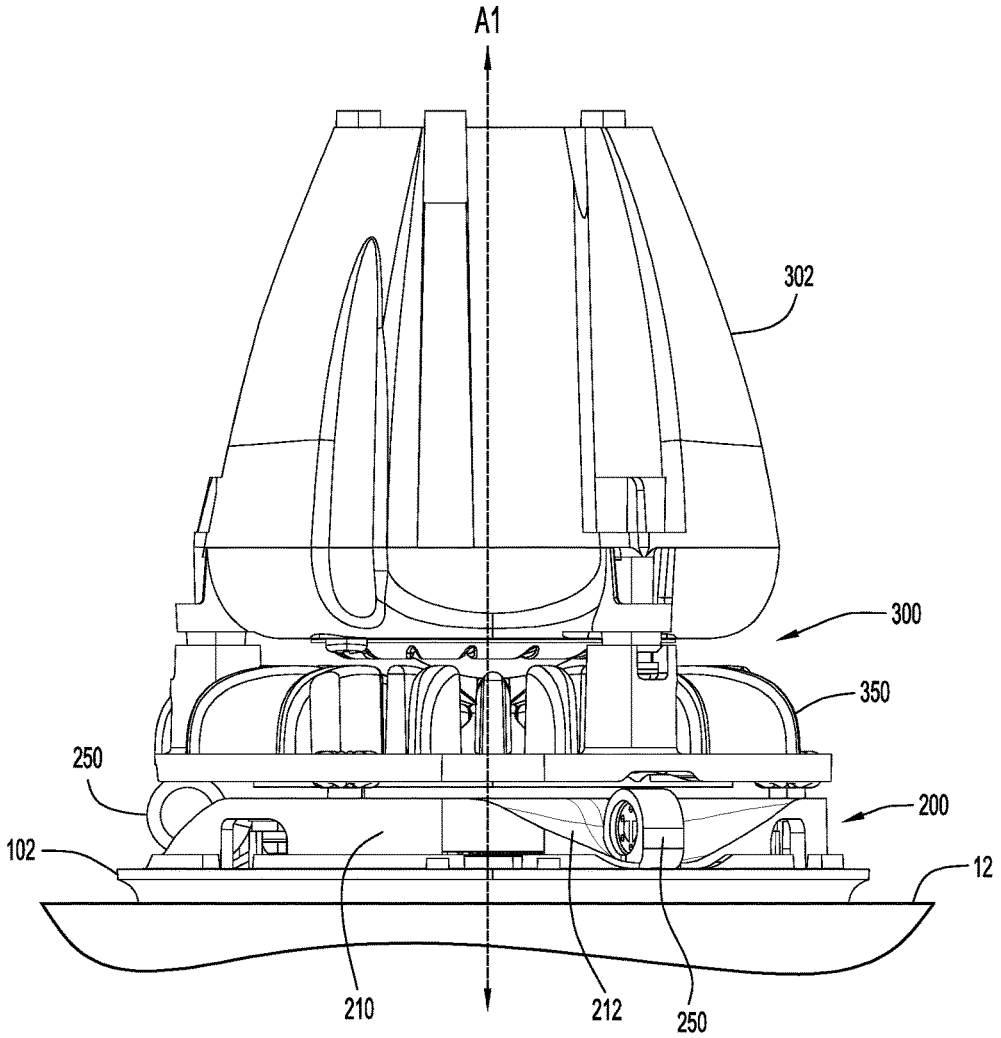
FIG. 3 is a diagram illustrating a side view of the audio endpoint of FIG. 1.

Referring first to FIGS. 1-3 for a description of an audio endpoint 10 configured in accordance with examples presented herein. In this particular arrangement, the audio endpoint 10 includes a sound-permeable cover or shell 100 which, for clarity, is shown removed from the audio endpoint 10 in FIG. 1 and omitted from the remaining diagrams. With the shell 100 removed, several components of the audio endpoint 10, including a base plate 102, a microphone assembly 200, and a speaker assembly 300 are shown. The base plate 102 is generally configured to support the audio endpoint 10 on a support surface 12, such as a table or desk. However, in different scenarios, the audio endpoint might be inverted or sidewise (i.e., hung from a ceiling or mounted to a wall). In these scenarios, the base plate 102 would still engage a support surface so that the support surface is under or beneath the audio endpoint 10.

The microphone assembly 200 includes a microphone waveguide 210 and microphones 250. The speaker assembly 300 includes a speaker chamber or housing 302, a speaker 304 (shown in FIGS. 8-17) and a speaker waveguide 350. In some embodiments, the speaker assembly 300 may also include a power cord (not shown) configured to supply power to electrical components included in the speaker assembly 300 or the entire audio endpoint 10.

FIGS. 1 and 2 are perspective views of the audio endpoint 10 and, as such, illustrate various features with various emphasis (i.e., the baseplate 102 is more fully illustrated in FIG. 2 while the speaker housing 302 is more fully illustrated in FIG. 1). However, in FIG. 3, the audio endpoint 10 is shown from a side perspective view. This view (as well as other views included in the Figures) demonstrates the general shape of the audio endpoint 10 and illustrates that the audio endpoint may sit flat on a support surface 12 in various rotational positions. That is, the audio endpoint may be rotated about a central axis A1 to any angular position and still sit or rest on the support surface 12. Moreover, as is described below in further detail, the various components of the audio endpoint 10 may be centered on axis A1, which may be referred to herein as a central, vertical axis.

Figure 4:
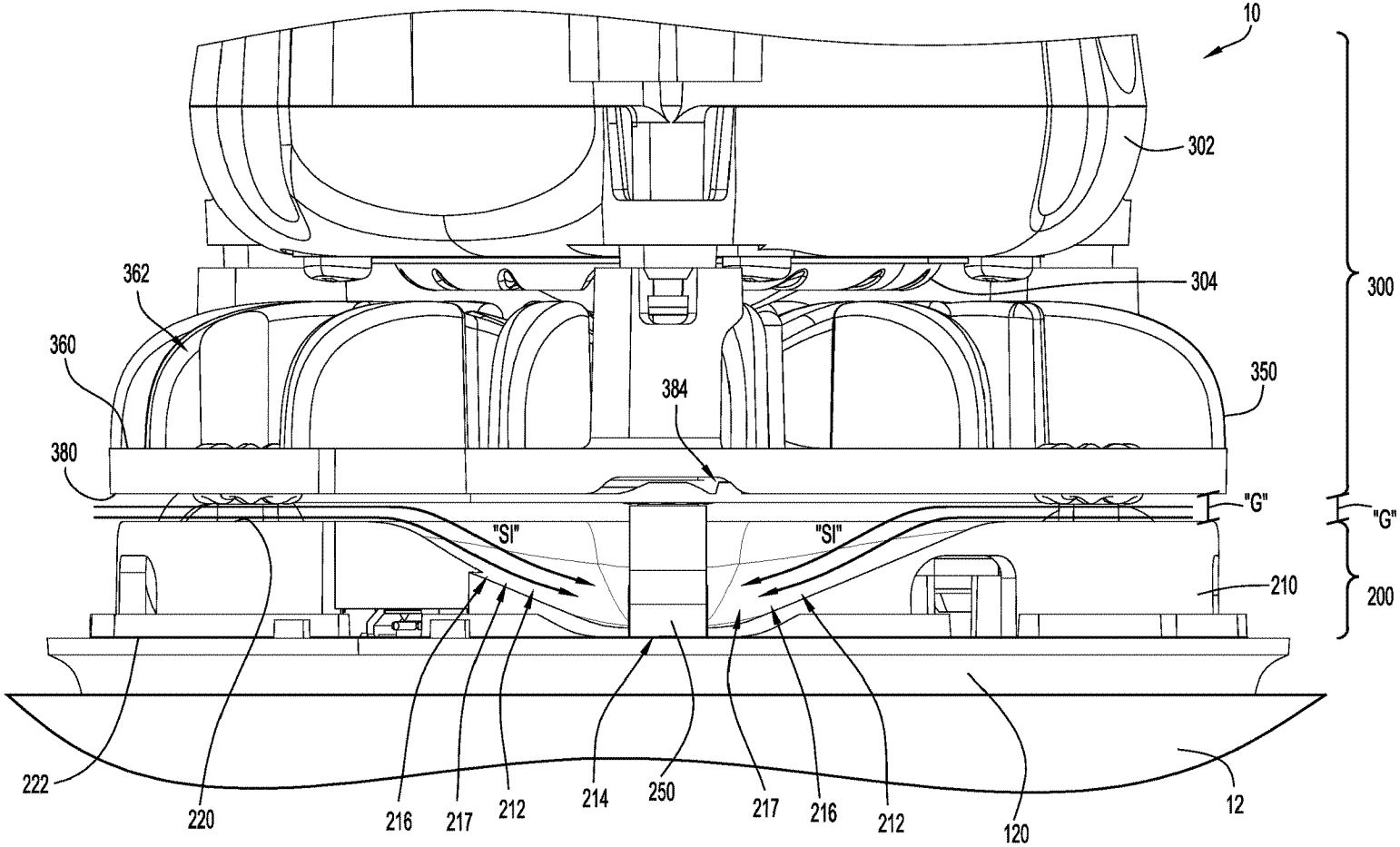
FIGS. 4 and 5 are diagrams illustrating side views of a lower portion of the audio endpoint of FIG. 1.
Figure 5:
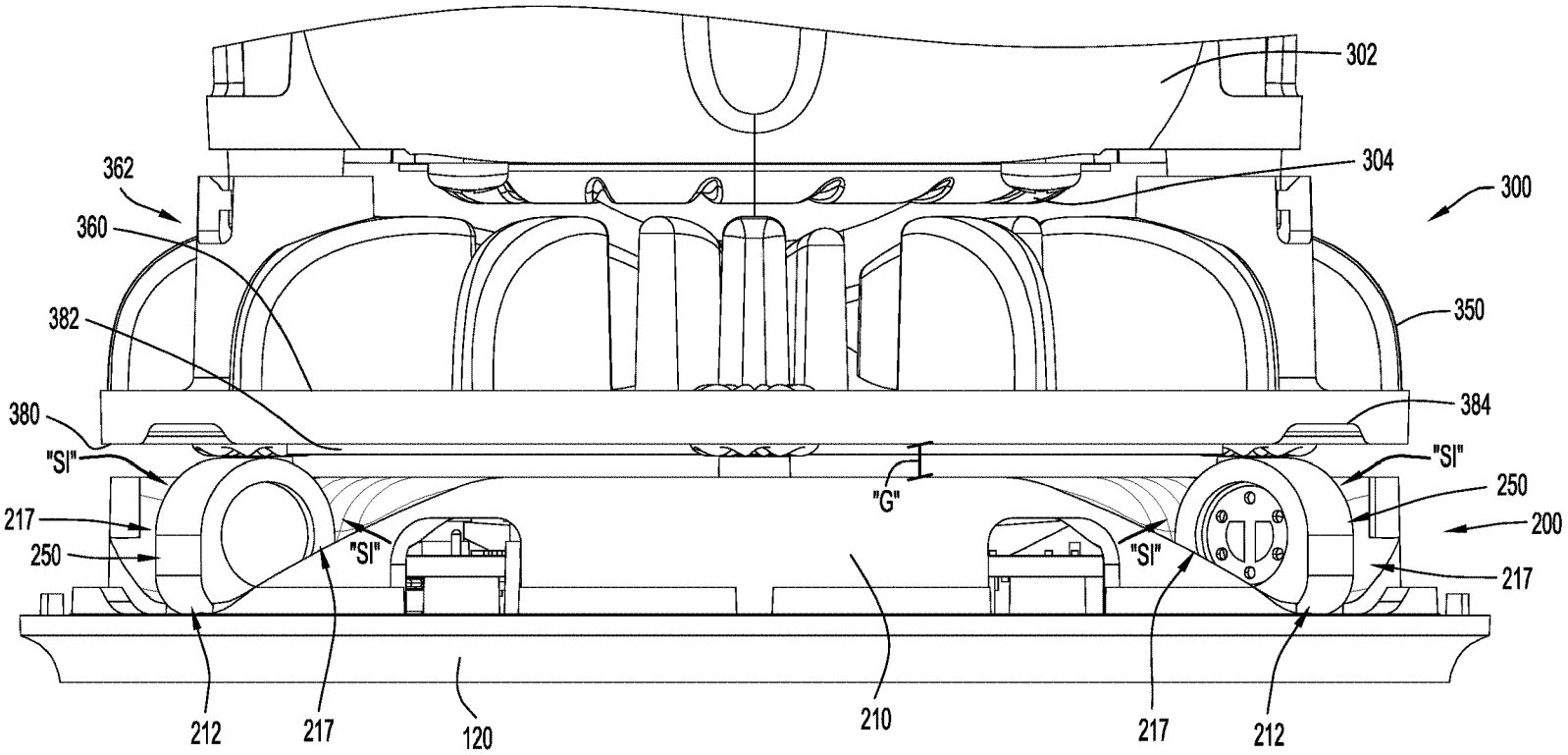

Still referring to FIGS. 1-3, but now with reference to FIGS. 4 and 5 as well, the base plate 102, microphone assembly 200, and speaker assembly 300 are all positioned vertically with respect to one another (i.e., stacked) such that the microphone assembly 200 is disposed between the base plate 102 and the speaker assembly 300. This arrangement contributes to the vibrational and acoustical isolation of the microphone assembly 200 (and the speaker assembly 300) at least because this arrangement positions the microphones 250 under the speaker waveguide 350, which removes the microphones 250 from a high pressure zone generated by the firing of the speaker 304 (which, in turn, increases echo rejection for the microphones 250). Meanwhile, the transducer of the speaker 304 is tightly coupled to the speaker waveguide 350 so that sound propagates radially outwards in 360 degrees (as is illustrated in at least FIGS. 9-12 by arrows S2). Acoustic and vibrational isolation is further supported by the designs of the speaker assembly 300 and microphone assembly 200. For example, as is described below in connection with FIG. 18, which is a perspective view of one arrangement of the speaker waveguide 350, the speaker waveguide 350 includes a top surface 360 that supports interleaved sets of fins 362 configured to propagate the sound from speaker 304 radially outward while smoothing the pressure generated by the speaker 304.

FIGS. 4-5 illustrate that the microphone assembly 200 and the speaker assembly 300 may also be physically separated to effectuate the aforementioned acoustic and vibrational isolation. Generally, the microphone waveguide 210 is separated from the speaker waveguide 350 by a gap "G" of, for example, approximately 2 mm (or 1.7 mm if a sound foil 382, which may be included on underside of the speaker waveguide 350 to further dampen sound and/or vibration, is considered part of the speaker waveguide 350). That is, the microphone waveguide 210 includes a top surface 220 that is separated from a bottom surface 380 of the speaker waveguide 350 by the gap "G." However, the top surface 220 of the microphone waveguide 210 also defines depressions or pockets 212 therein that gradually increase the height of the gap "G" at select locations around the audio endpoint 10. Each pocket 212 is configured to receive one of the microphones 250. To accommodate the microphones, the bottom surface 380 of the speaker waveguide 350 may include notches 384 that are generally aligned with the pockets 212 to provide a gap between the microphones 250 and the speaker waveguide 350. However, this gap may be intended to facilitate installation and, in some examples, may not necessarily provide a gap of the same distance of gap "G." That is, in at least some examples, the gap between the microphones 250 and the speaker waveguide 350 may not provide the same amount of separation as the gap "G" and should not be considered as part of gap "G."

That being said, it is to be appreciated that the separation provided by gap "G" need not be approximately 2 mm and, instead, may be approximately 1 mm or any other desirable amount of space. Still further, in some examples, the microphone waveguide 210 and the speaker waveguide 350 may be in contact, provided that the microphone waveguide 210 and the speaker waveguide 350 still provide vibrational and acoustic isolation for the speaker 304 and microphones 250. However, separation provided by a gap "G" may be advantageous to ensure that the microphones 250 are located outside of a high pressure zone created by the speaker 304. Moreover, separation may move the microphones 250 closer to a table, desk, or other such support surface 12 upon which the audio endpoint 10 is resting, which may decrease combing effects and increase high-frequency extension. For example, in at least some examples, the microphones 250 may be positioned approximately 4 mm above the support surface 12 on which the audio endpoint is resting (a bottom surface 222 of the microphone waveguide 210 may be contoured to mirror the top surface and, thus, may minimize the separation between the microphones 250 and the baseplate 102).

The proximity of the microphones 250 to the support surface 12 and the relatively small gap "G" provided between the microphone assembly 200 and the speaker assembly 300 also places the speaker 304 relatively close to the support surface 12. Positioning a downward-firing speaker 340 (i.e., a speaker 304 that is configured to emit sound towards the support surface, as is illustrated in at least FIGS. 8A and 9-12) close to the support surface 12 increases broadband efficiency by approximately 6 dB, which is the equivalent of using ¼ the power. This provides a much more linear low Total Harmonic Distortion (THD) response. Firing the speaker 304 downward also decreases the impact of phase cancellations. By comparison, a local listener receives direct and indirect sound waves from an upward-firing speaker. The indirect sound waves (table bounce path cancellations) arrive 180 degrees out of phase and occur at specific frequencies, depending on the angle of the listener with respect to the table and the corresponding wavelength. Moreover, firing a speaker upwards does not greatly decrease the sound pressure level at the microphones, and actually increases nonlinearity (distortion) since the speaker excursion is greater at higher voltage levels.

Still referring to FIGS. 4-5, the pockets 212, which may also be referred to herein as microphone pockets 212, include a base or bottom 214 with two sides 216 that gradually slope upwards, away from the base plate 102 as the sides 216 move away from the bottom 214. In this particular example, each side 216 spans approximately 90 degrees, such that the pocket 212 is shaped substantially similar to approximately half of a hemispherical depression. This particular shape creates acoustical impedance pockets 217 on opposite sides of a microphone 250 (i.e., a bidirectional microphone) positioned at the bottom 214 of the pocket 212. The acoustical impedance pockets 217 serve to draw sound into the microphones 250 by gradually lowering resistance to allow sound from a talker/speaker/user (human speaker, not the device's speaker) to push through to one of the microphones 250, as is shown by arrows "S1" included in FIG. 4. Consequently, in other examples, the pockets 212 may be shaped in any desirable manner that creates impedance pockets 217 on both sides of one of the microphones 250 positioned therein.

Figure 6:
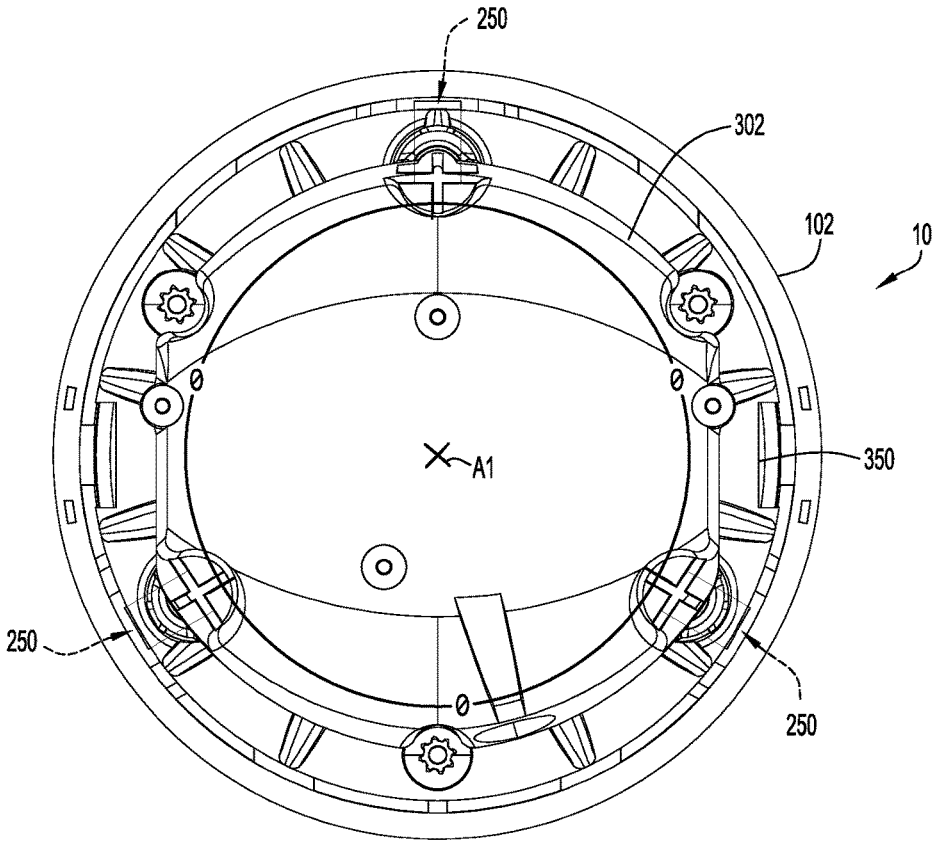
FIG. 6 is a diagram illustrating a top view of the audio endpoint of FIG. 1.
Figure 7:
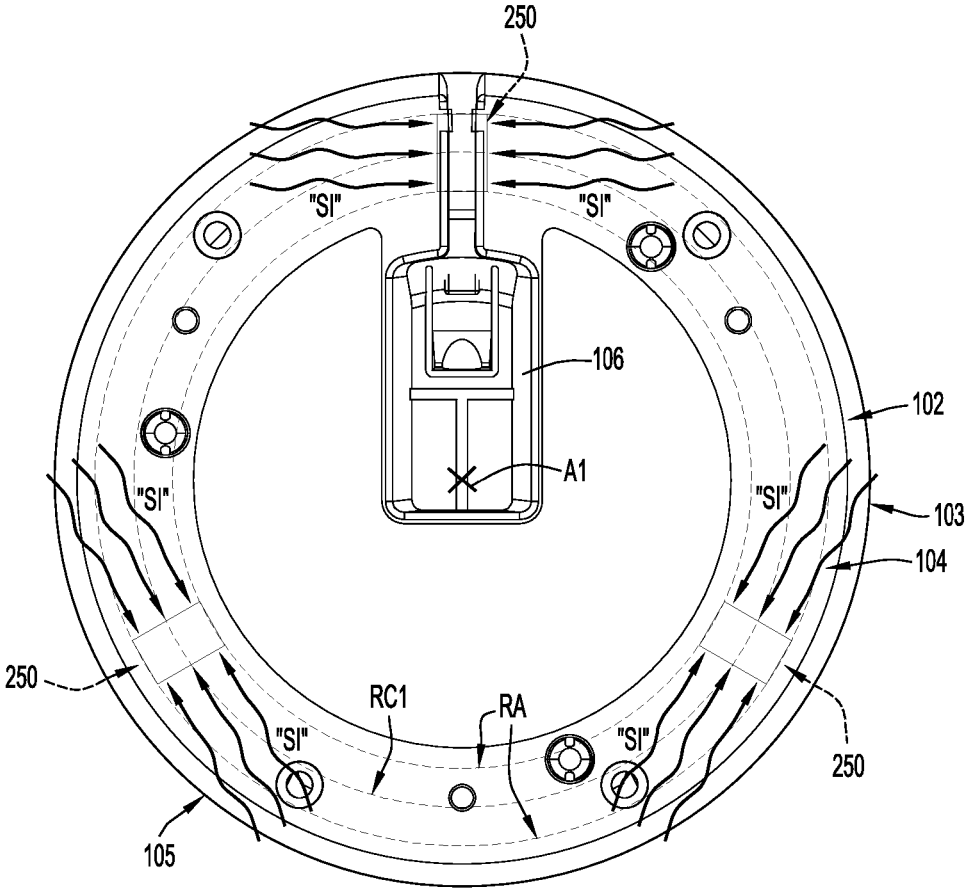
FIG. 7 is a diagram illustrating a bottom view of the audio endpoint of FIG. 1.
Figure 8A:
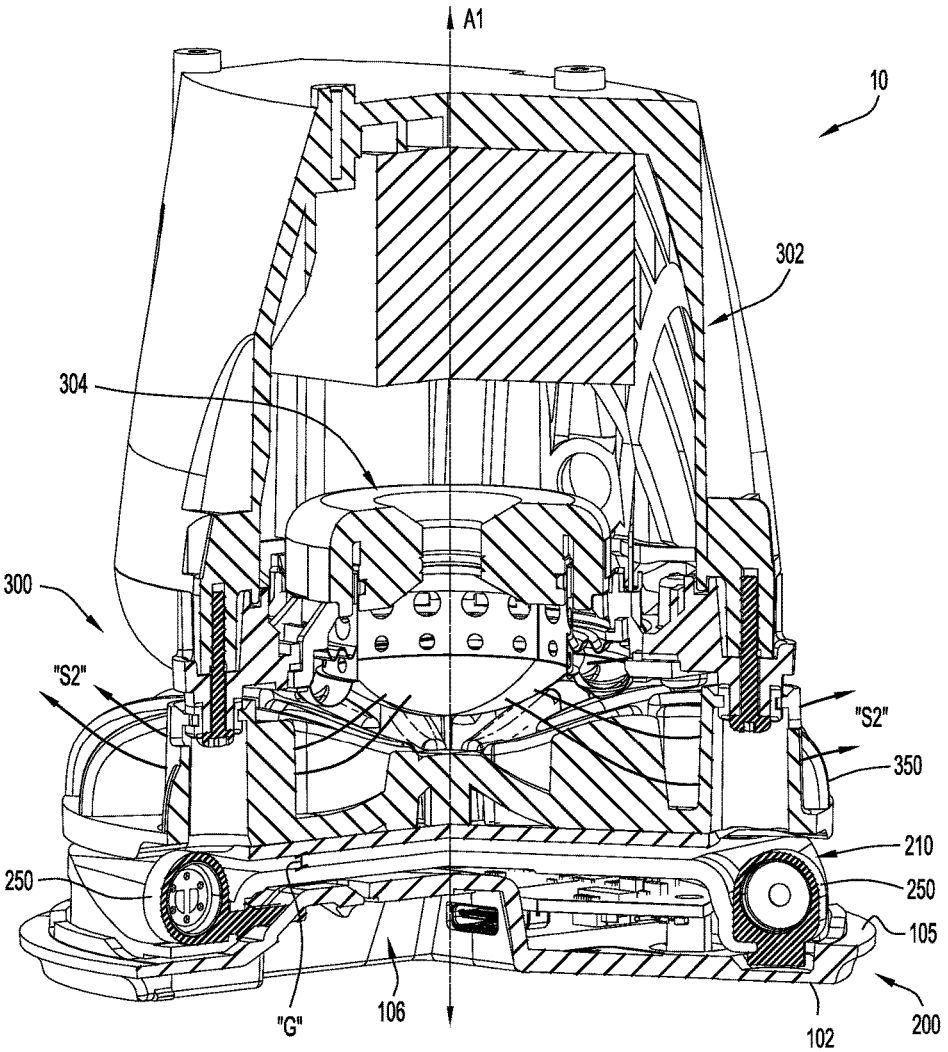
FIG. 8A is a diagram illustrating a sectional view of the audio endpoint of FIG. 1.
Figure 8B:
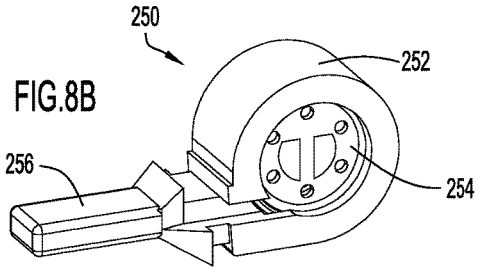
FIG. 8B is a diagrams illustrating a side perspective view of a microphone included in the audio endpoint of FIG. 1.
Figure 9:
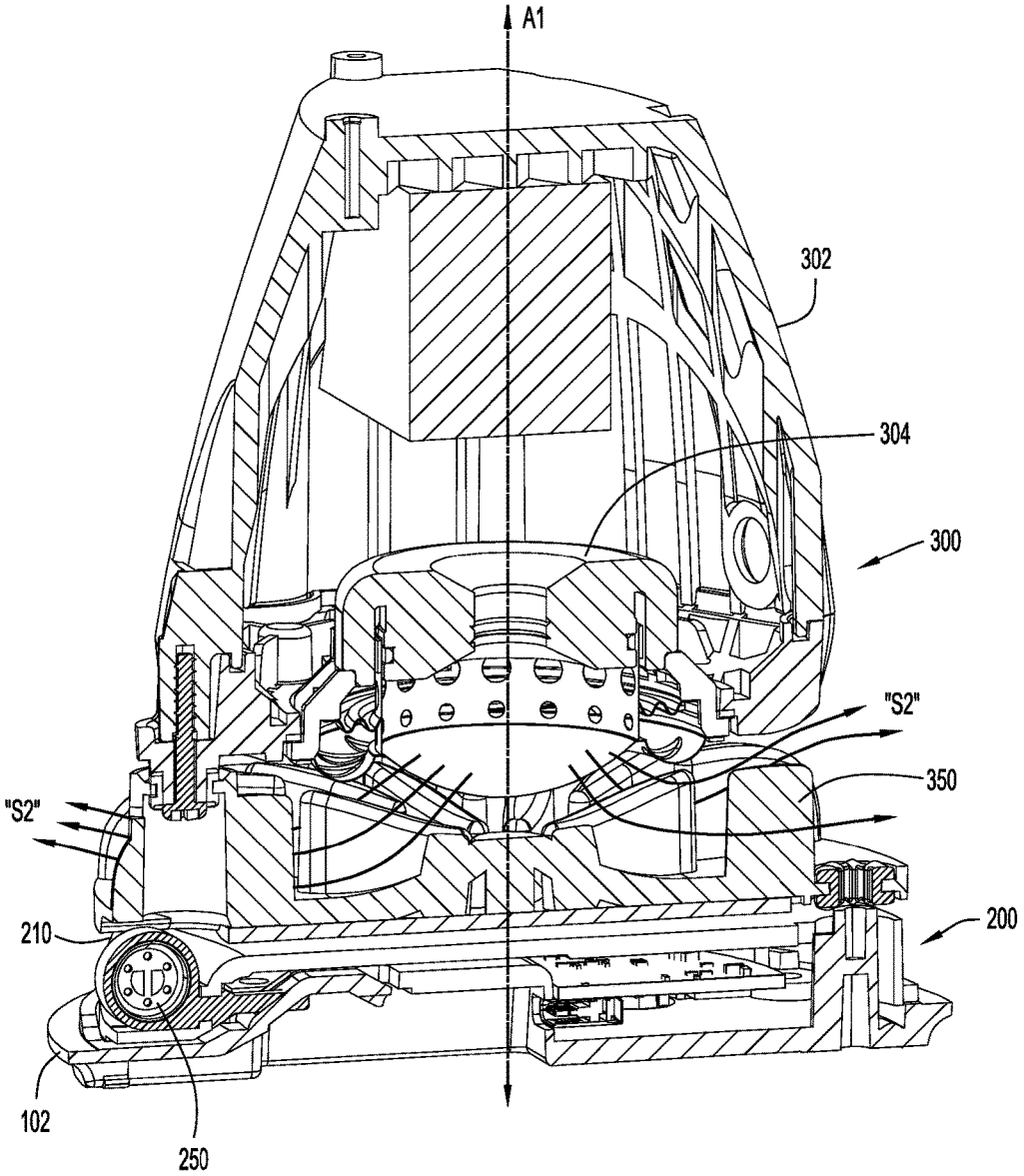
FIGS. 9-12 are diagrams illustrating different side, sectional views of the audio endpoint of FIG. 1.
Figure 10:
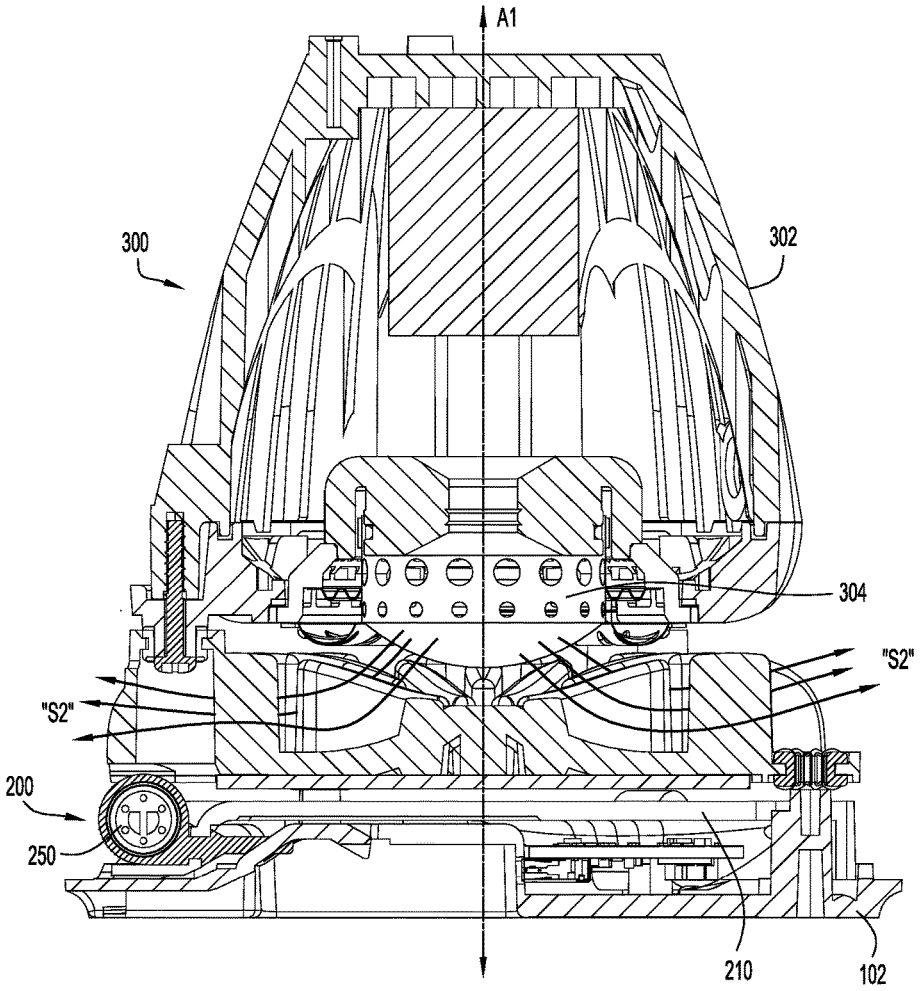

FIGS. 6 and 7 are top and bottom views, respectively, of the example audio endpoint 10. In these figures, three microphones 250 are shown in outlining because the majority of the microphones 250 are obscured by the speaker waveguide 350 or base plate 102. Regardless, FIGS. 6 and 7 illustrate how the microphones 250 are disposed radially around the device 10 and more specifically, radially around the central axis A1. However, before describing the position and orientation of the microphones 250, the features of the baseplate 102 illustrated in FIG. 7 are described first.

In particular, the baseplate 102 includes an exterior edge or circumference 103 that extends between a bottom surface 104 and a top surface 105 (also shown in FIG. 8). The exterior edge 103 is generally centered on the central vertical axis A1, but in other examples, need not be, provided that the base plate 102 stably supports the audio endpoint 10 on a support surface 12. The base plate 102 may be relatively small, such as approximately 10 cm in diameter, to provide a small horizontal footprint or form factor, but may also include a number of features to support assembly and usage, such as USB receptacle 106 and openings (not labeled) to receive connectors (i.e., screws, grommets, or other such fasteners).

Now turning back to the microphones 250, in this particular example, the microphone assembly 200 includes three microphones 250 and, thus, as shown in FIG. 6, each of the microphones are separated by an angle θ of approximately 120 degrees. That is, the microphones 250 are radially spaced, at equidistant intervals, around a reference circle RC1 concentric with a circumference of the microphone waveguide 210, as shown in FIG. 7 (insofar as the term reference denotes a geometric reference that may not be physically represented in the audio endpoint 10). Put still another way, the microphones 250 may be aligned within a reference annulus RA centered on the central vertical axis A1 of the microphone waveguide, such that an inner edge of each microphone 250 is aligned with an inner wall of the reference annulus RA and an outer edge of each microphone 250 is aligned with an outer wall of the reference annulus RA, as is also shown in FIG. 7. In this example, the microphones 250 may be inset from the edge of the speaker waveguide 350 by, for example, approximately 5 mm (which, in some examples, may also inset the microphones 250 from the edge of the microphone waveguide 210 by approximately 5 mm).

Positioning three microphones 250 with approximately 120 degree separation therebetween maximizes coverage while also enabling beam forming techniques to be utilized with the microphones. However, in other examples, four equidistant microphones 250 (i.e., 90 degree separation), six equidistant microphones 250 (i.e., 60 degree separation), two microphones 250 with 180 degree separation, or any such combination of microphones 250 could be incorporated into the audio endpoint. However, increasing the number of microphones 250 may negatively affect beam-forming algorithms implemented with the audio endpoint due to the polarity of the bi-directional microphones. For example, four microphones 250 may create corner cases where the positive and negative lobes of different bi-directional microphones pick up the same thing when two talkers talking at the same time. Alternatively, six microphones 250 may require the microphones to be paired, which may increase the complexity of the audio endpoint. On the other hand, if only two microphones 250 are used, shadowing effects may occur when full coverage (i.e., 360 degree coverage) is achieved.

Still referring to FIGS. 6 and 7, but now with reference to FIGS. 8A, 8B, and 9-12 as well, the microphones 250 are also oriented perpendicularly to the central vertical axis A1 (i.e., an axis going into the page of FIGS. 6 and 7) and the speaker 304 of the audio endpoint 10, so that a null 252 (see FIG. 8B) of each microphone 250 is pointed at the speaker 304. Moreover, in the depicted example, the microphones 250 are bi-directional microphones, such as bi-directional electret condenser microphones (ECMs), and the bi-directional microphones are oriented (within each microphone pocket 212) so that the faces or lobes 254 (see FIG. 8B) of each ECM are perpendicular to the interior and exterior walls of the reference annulus RA (i.e., the faces span the reference annulus RA). Consequently, each microphone 250 receives audio input (at the lobes 254) laterally, as shown by arrows "S1" included in FIG. 7, via the impedance pockets 217 (see FIGS. 4 and 5) provided by the microphone pockets 212 of the microphone waveguide 210. That is, each microphone 250 picks up sound from directions that are approximately tangent to any reference circle that is within and concentric to the reference annulus RA (and, thus, concentric to a circumference of the microphone waveguide 210 and/or base plate 102). Put still another way, each microphone 250 picks up sound from directions that are approximately tangent to an outer circumference of the microphone waveguide 210. In different examples, different bi-directional microphones 250 may be utilized to effectuate this sound pickup. However, the bi-directional microphones 250 generally have a high Signal-to-Noise Ratio (SNR) to enable the microphones 250 to pass acoustic compliance send noise tests, even when the audio device is a conference phone that requires more preamplifier gain than typical desktop phones (because users are typically 1-2 meters away).

As mentioned above, in the example depicted in FIGS. 8A and 9-12, the bi-directional microphones 250 are positioned with the null 252 of the microphone pointing at the speaker 304. Consequently, the microphones 250 intake audio from a direction that is perpendicular to the output of the speaker 304, which propagates radially outward via the speaker waveguide 350, as is generally illustrated by arrows "S2". That is, the microphones 250 are aligned with a radius extending from the central vertical axis A1 (which may be the center of the microphone waveguide 210), so that audio is drawn in laterally or tangential to a reference circle that is centered about the central vertical axis A1. This orientation minimizes echo return (i.e., maximizes echo rejection, especially at low frequencies) by providing a front-to-rear diaphragm cancellation. More specifically, acoustic pressure reaches both sides of the microphone 250 simultaneously and, thus, incoming pressure counteracts and cancels. By comparison, uni-directional microphones positioned in any orientation (polar response pointed 90 degrees, 120 degrees, 150 degrees, or 180 degrees away from the device's speaker 304) may not provide acceptable results given the small footprint of the device 10. The pressure equalization provided by the orientation of the microphones 250 is especially effective at low frequencies.

Figure 11:
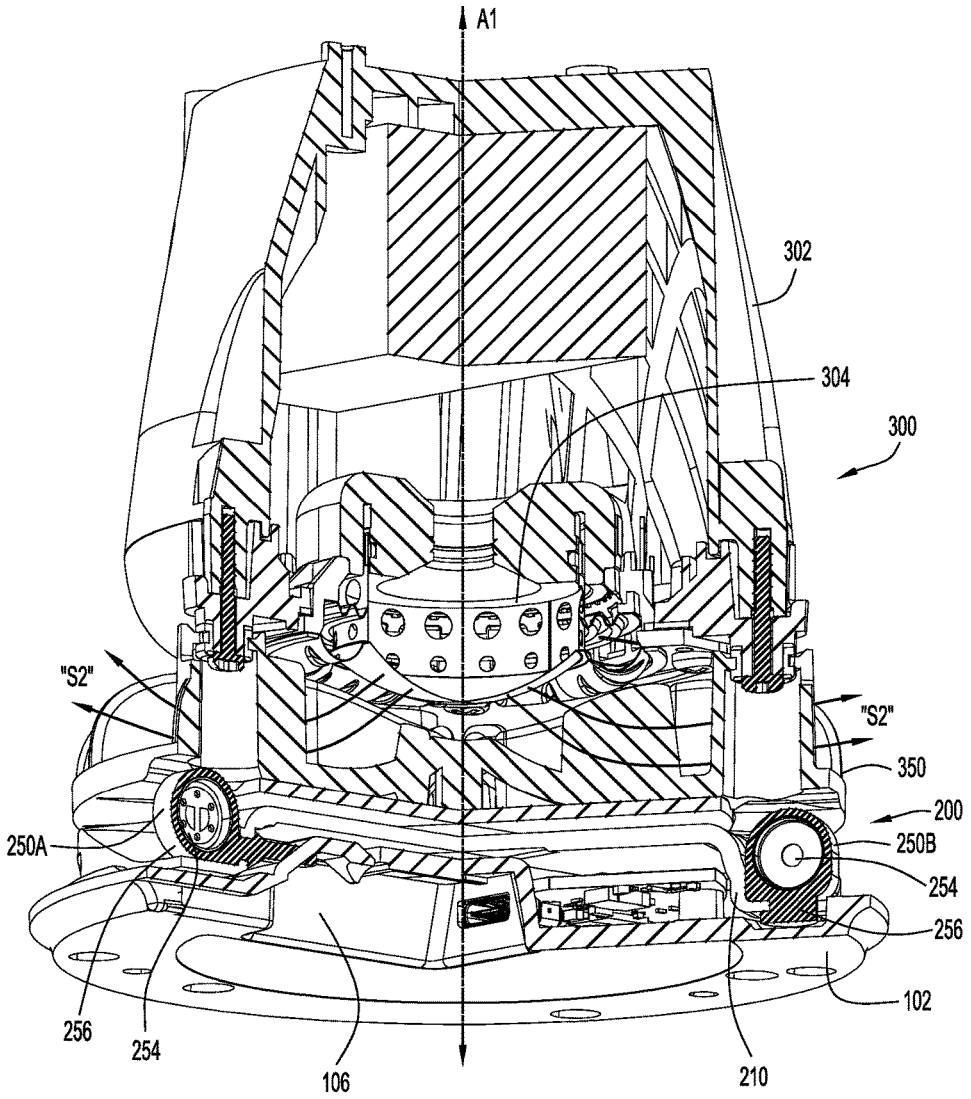
Figure 12:
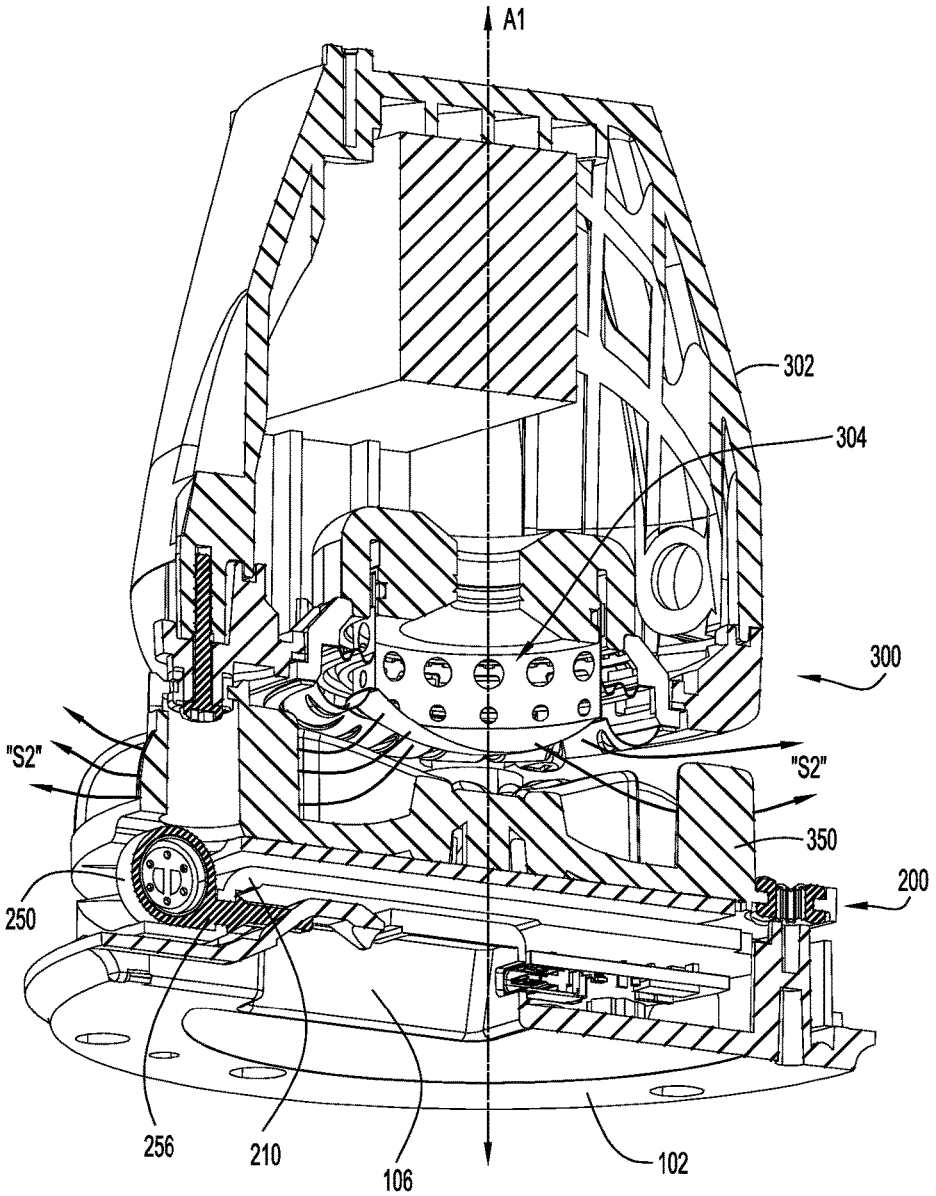
Figure 13:
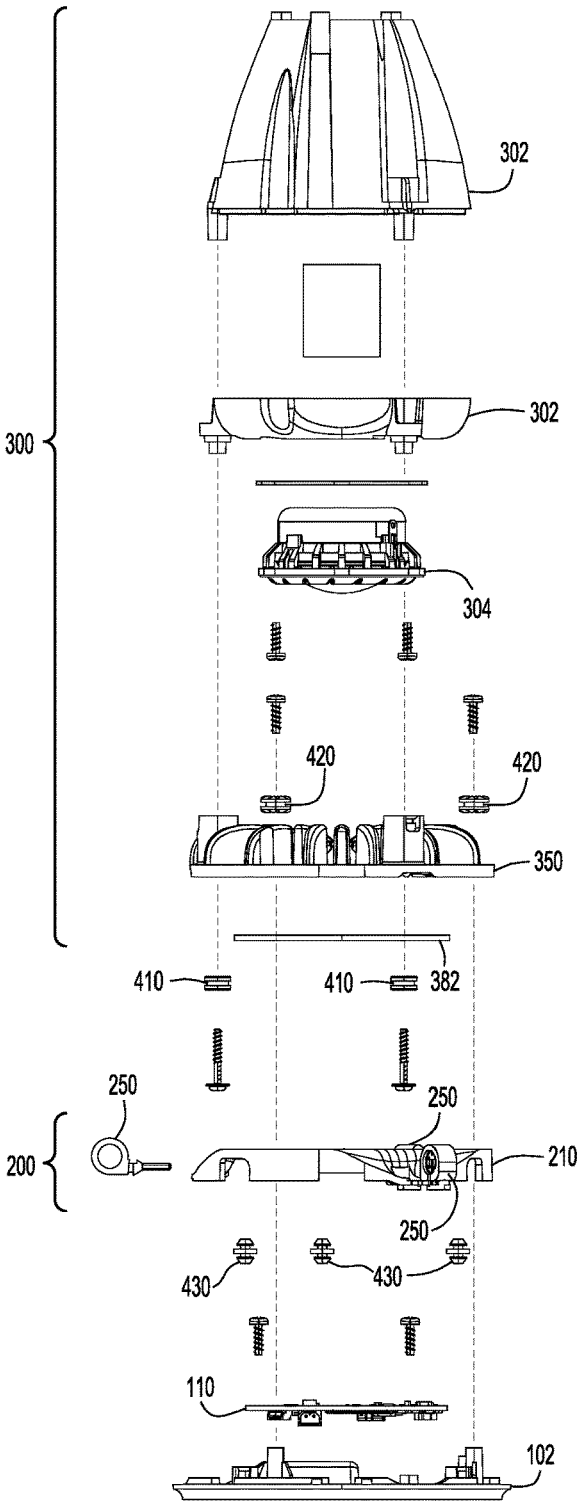
FIGS. 13-17 are diagrams illustrating exploded views of the audio endpoint of FIG. 1.
Figure 14:
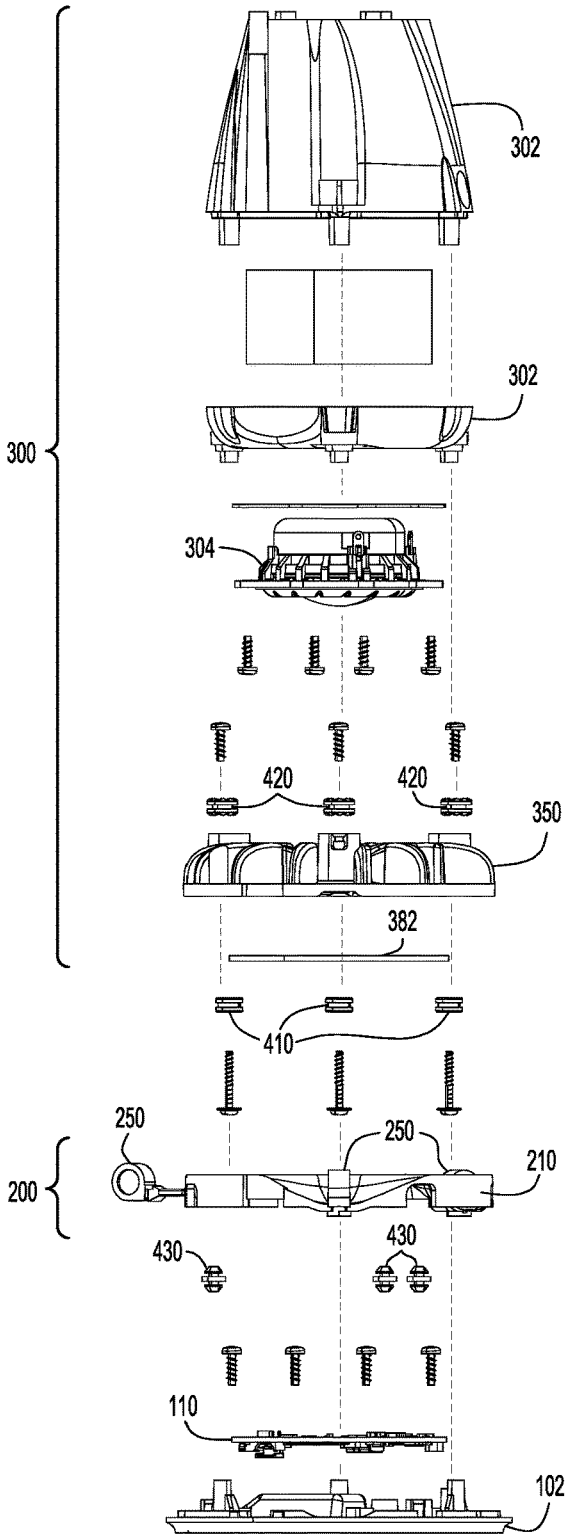
Figure 15:
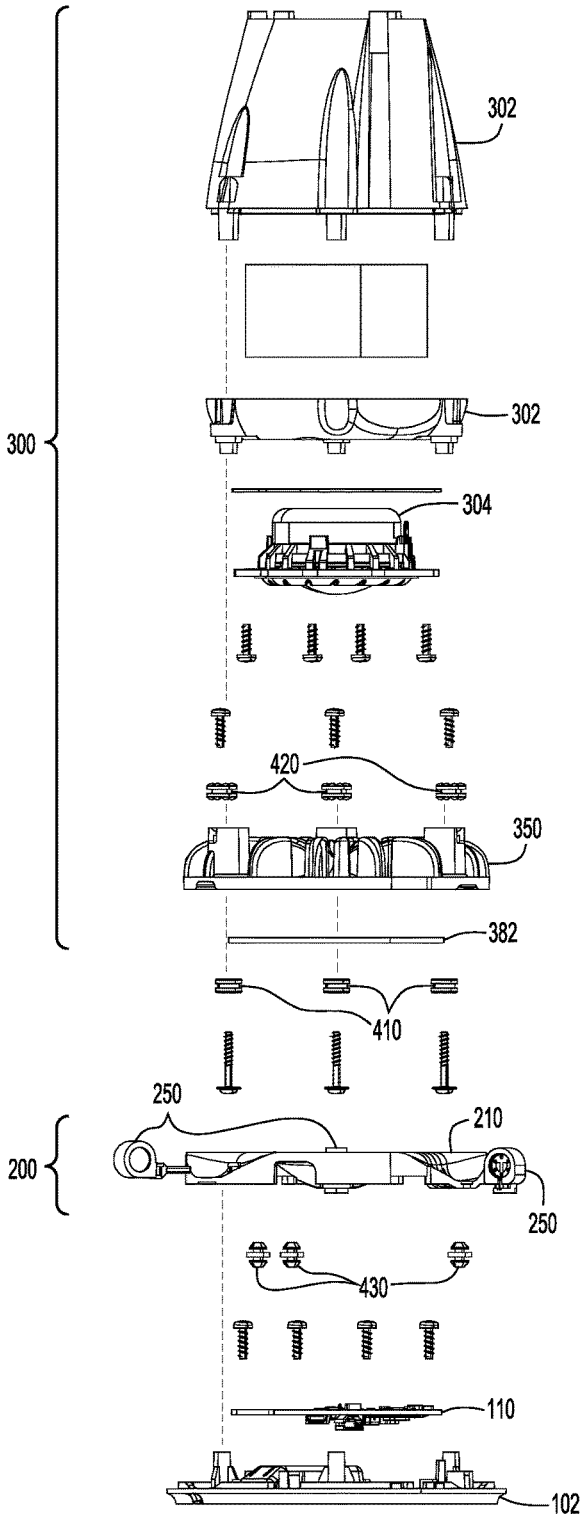
Figure 16:
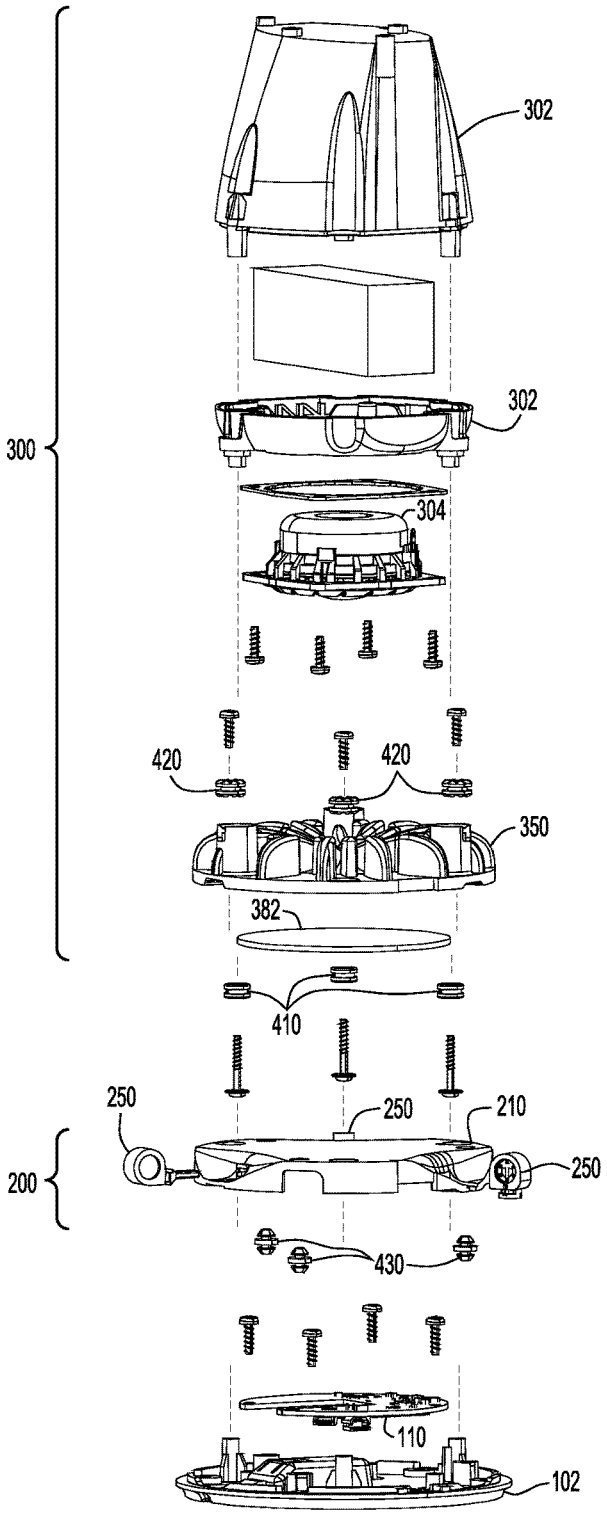
Figure 17:
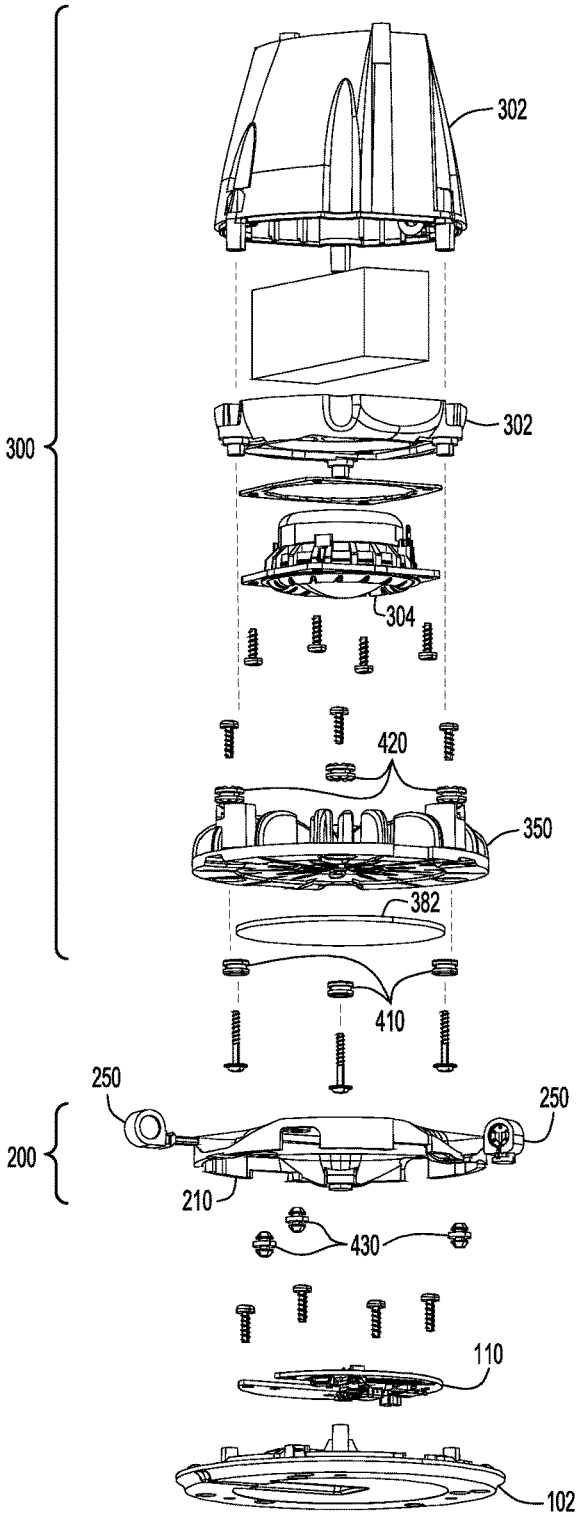

As noted above, the three bi-directional microphones 250 included in the depicted example are ECMs. The three ECMs may be mounted on the device (in the microphone pockets 212 of the microphone waveguide 210) in different mic boots 256 (see FIG. 8B), but this does not change the properties of the ECMs 250. For example, in FIG. 11, the ECM on the left (labeled as microphone 250A for clarity, but to be understood to be one of microphones 250) is mounted within a pull-through mic boot 256 and the ECM on the right (labeled as microphone 250B for clarity, but to be understood to be one of microphones 250) is mounted within a push through mic boot 256. This particular configuration is simply utilized for spacing and/or assembly (i.e., to accommodate the USB receptacle 106 included in the base plate 102), but orients ECM 250A approximately 2 mm higher than the ECM 250B. This height differential does not impact the performance of the microphones 250 (or the audio endpoint 10) and does not remove ECM 250A from the reference annulus RA that is centered around/on the central vertical axis A1 of the device 10. However, the height difference does vertically offset the center of ECM 250A from a reference circle that extends through the center of ECM 250B. In FIG. 11, the front lobe 254 of ECM 250B is shown and the back lobe 254 of ECM 250A is shown. Notably, the front lobe 254 has positive polarity and the back lobe 254 has negative polarity.

FIGS. 13-17 illustrate exploded views of the audio endpoint 10. In the exploded views, the lowest part of the audio endpoint 10 is the base plate 102. Moving upwards, the exploded view illustrates a PCB 110 that can be installed or incorporated into the baseplate 102, the microphone waveguide 210 and the microphones 250, the speaker waveguide 350 (including a sound foil 382), the speaker 304, and the speaker housing 302 that are all included in the device. In different examples, these components may be assembled in any manner. However, as noted above, the speaker assembly 300 (i.e., at least the speaker 302 and speaker waveguide 350) and the microphone assembly 200 (i.e., at least the microphone waveguide 210 and the microphones 250) are vibrationally isolated. In this particular example, vibrational isolation is achieved with strategic couplings and dampening fasteners or couplers (i.e., grommets).

More specifically, the speaker waveguide 350 is coupled to the speaker housing 302 with a first set of dampening fasteners 410 and is coupled to the base plate 102 with a second set of dampening fasteners 420. Meanwhile, the microphone waveguide 210 is coupled to the baseplate 102 with a third set of dampening fasteners 430. The dampening fasteners help decouple mechanical vibrations generated by the speaker 304 from the microphones 250. This improves echo rejection, isolates the speaker 304, as well as the speaker chamber (disposed within the speaker housing 302) from the speaker waveguide 350, and isolates that microphone assembly 200 from the speaker assembly 300. To accommodate dampening fasteners 410, 420, and 430, as well as any other couplers (i.e., for mounting a cover/shell 100 or any other components), different components of the audio endpoint 10 (i.e., the baseplate 102 and the speaker waveguide 350) may include bosses, notches, couplers, or any other such features, such as bosses 351 (see FIG. 18). These features may be positioned to minimize audio interference and may also be filled or plugged to minimize resonance or vibration. Different examples may include any such features, provided that the microphone assembly and the speaker assembly are vibrationally isolated from each other.

Figure 18:
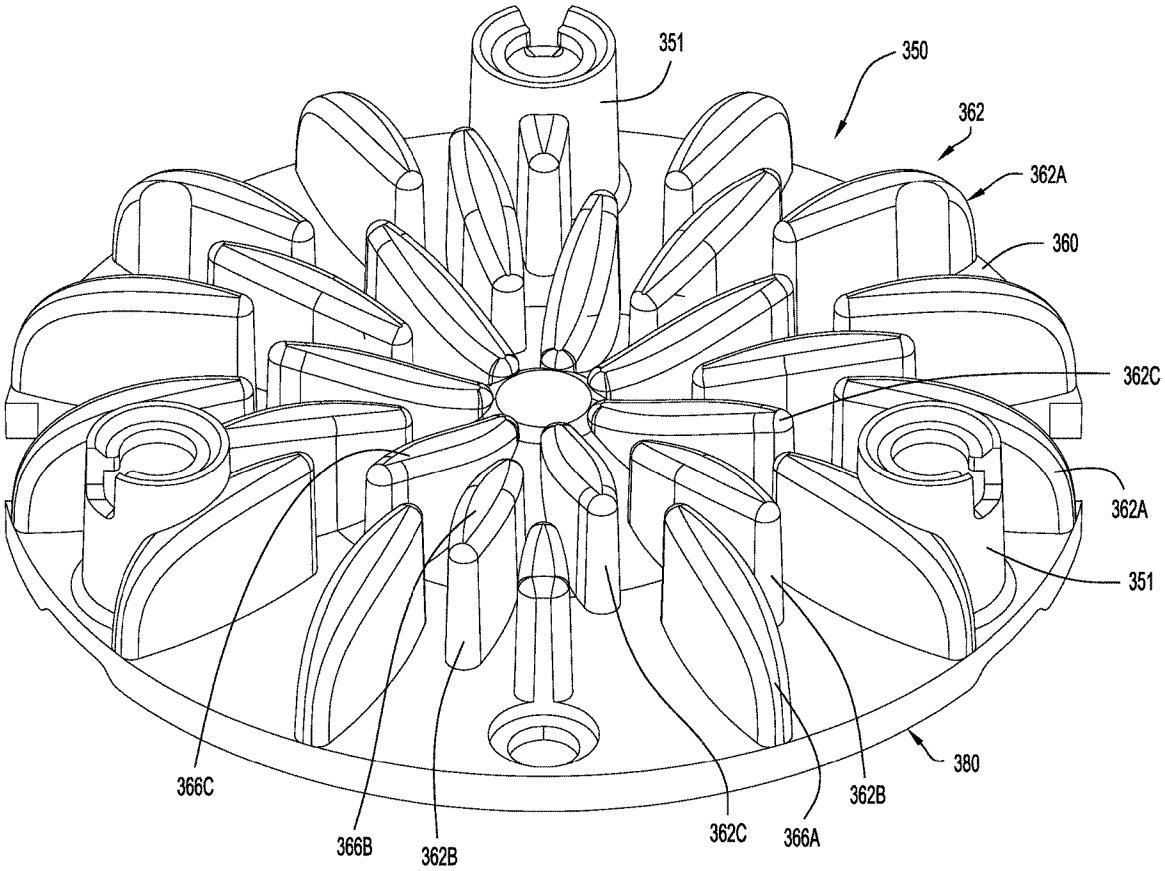
FIG. 18 is a perspective view of the speaker waveguide in an audio endpoint, in accordance with example embodiments presented herein.

Now referring to FIG. 18, for a description of speaker waveguide 350. Generally, the speaker waveguide 350 is designed to smooth pressure from the center out over a broad frequency range. In order to accomplish this, the speaker waveguide 350 includes sets of fins/protrusions 362 that are arranged in a particular arrangement along a top surface 360 of the speaker waveguide.

For example, in the depicted example, the sets of fins 362 includes a first set 362A, a second set 362B, and a third set 362C. Each of the three sets includes radially spaced protrusions, with the first set 362A encircling an outer portion of the top surface 362, the third set 362C encircling an inner or central portion of the top surface and the second set 362B encircling an area therebetween. However, the first set 362A, the second set 362B, and the third set 362C do not cover independent radial areas, instead, the sets overlap in an interleaved manner. In particular, the second set of fins 362B radially overlaps with the first set 362A and the third set 362C.

Additionally, in the depicted example, the fins of the first set 362A, the second set 362B, and the third set 362C each have a different top surface. The fins in first set of fins 362A each have a top surface 366A that slopes downwards moving away from the center of the waveguide 350. By comparison, the fins in the second set of fins 362B have a top surface 366B that is substantially flat (or slightly convex in a symmetrical manner) and the fins in the third set of fins 362C have a top surface 366C that is sloped upwards moving away from the center of the waveguide 350. This particular arrangement of fins is configured to smooth and radially propagate sound from the speaker; however, in other examples, other arrangements of protrusions/fins of any size and shape may also be utilized to smooth and propagate sound emitted from the speaker. Moreover, in at least some examples, such as the example depicted in FIGS. 1-18, the speaker waveguide 350 includes cylindrical bosses 351 or other such artifacts that are used for assembly and/or manufacturing. In the example depicted in FIGS. 1-18, cylindrical bosses 351 are positioned to minimize interference.

Collectively, the combination of features included in the audio device presented herein provide excellent audio quality. For example, echo return for the example audio endpoint 10 is very low, especially at low-frequencies. This is especially advantageous because low-frequencies are typically the limiting factor for AEC algorithm performance in traditional designs (which typically utilize uni-directional ECMs). Moreover, integrating bi-directional ECMs in the manner described above allows the AEC algorithm to cancel echo for consistent, full-duplex communication. The positioning of the bi-directional ECMs perpendicular to the speaker, underneath the high-pressure speaker waveguide outlet and close to a support surface that the device is resting on is particularly critical for echo cancelling. For example, placing the ECMs as close to the table as possible allows the microphones to meet wideband compliance standards. Put another way, the audio endpoint presented herein can achieve full-duplicity.

By comparison, devices with microphones disposed at the top of the device may experience combing effects and bounce, which creates undesirable acoustic coupling. Combing effects lower the frequency of a notch and, thus, microphones disposed atop a device may not satisfy communication standards for certain octaves (since these devices may have nulls were mic doesn't capture a voice). These devices (or others) may attempt to utilize AEC algorithms to achieve acceptable echo quality and these AEC algorithms may work well when the SPL of the device's speaker (calibrated at Telecommunications Industry Association (TIA), −30 degrees from horizontal, 0.5 m away, measured by a reference microphone) has an equivalent broadband amplitude received by the device's microphone. However, the AEC may not maximize echo return loss. The AEC is also a linear echo canceller, meaning that any distortion received by the microphone and the AEC cannot be effectively cancelled. Thus, full-duplex communication with AEC performance requires the microphone to receive low distortion and low SPL's. By comparison, the audio endpoint presented herein is able to provide full bandwidth coverage and high frequency extension without the negative impact of combing effects (at least because the microphones are proximate the support surface). In fact, the increase in audio quality provided by the configuration presented herein may even allow speakers (or personal assistants) with limited-capability AEC's to provide high quality audio if the configuration presented herein is incorporated into these speakers (or personal assistants).

To summarize, in one form, an audio endpoint is provided comprising: a base configured to engage a support surface; a speaker configured to fire in a downward direction, towards the base; a speaker waveguide disposed between the speaker and the base and configured to guide sound output by the speaker in radially outward directions; a microphone waveguide disposed between the speaker waveguide and the base; and two or more microphones disposed within the microphone waveguide so that the two or more microphones are proximate the base and the support surface.

In another form, an audio endpoint is provided comprising: a base plate configured to support the audio endpoint on a support surface; a speaker assembly including: a speaker configured to emit sounds towards the base plate; and a speaker waveguide disposed between the speaker and the base plate; and a microphone assembly disposed between the speaker assembly and the baseplate, wherein the microphone assembly is vibrationally and acoustically isolated from the speaker assembly.

In yet another form, audio endpoint is provided comprising: a base plate configured to support the audio endpoint; a speaker assembly including a speaker that emits sounds towards the base plate; and a microphone assembly, including: a microphone waveguide that is disposed between the speaker and the baseplate and includes a plurality of graduated microphone pockets; and a plurality of microphones, each of which is positioned at the bottom of one of the graduated microphone pockets in an orientation that allows each of the plurality of microphones to pick up sound from directions that are approximately tangent to an outer circumference of the microphone waveguide.

Although the techniques are illustrated and described herein as embodied in one or more specific examples, it is nevertheless not intended to be limited to the details shown, since various modifications and structural changes may be made within the scope and range of the invention. In addition, various features from one of the embodiments discussed herein may be incorporated into any other embodiments. Accordingly, the appended claims should be construed broadly and in a manner consistent with the scope of the disclosure.

What is claimed is:

1. An audio endpoint comprising:

a base configured to engage a support surface;

a speaker configured to emit sounds in a direction of the base;

a speaker waveguide disposed between the speaker and the base and configured to guide the sounds output by the speaker in radially outward directions;

a microphone waveguide disposed between the speaker waveguide and the base;

two or more microphones disposed within the microphone waveguide, wherein the two or more microphones are positioned proximate to the base; and a gap disposed between the speaker waveguide and the microphone waveguide that allows low frequency pressure to pass through the audio endpoint between the speaker waveguide and the microphone waveguide.

2. The audio endpoint of claim 1, wherein the gap has a height of approximately 2 mm, such that a top surface of the microphone waveguide is separated from a bottom surface of the speaker waveguide by at least 2 mm.

3. The audio endpoint of claim 1, wherein the microphone waveguide comprises:

microphone receptacles that are each configured to receive one of the two or more microphones, wherein the microphone receptacles create impedance pockets on either side of each of the two or more microphones.

4. The audio endpoint of claim 3, wherein the each of the impedance pockets are configured to draw sound towards each of the two or more microphones in a direction perpendicular to at least one of the radially outward directions in which the speaker waveguide guides the sound output by the speaker.

5. The audio endpoint of claim 1, wherein the two or more microphones are bidirectional microphones that each include two lobes and each of the two lobes is oriented to receive sound in a direction perpendicular to the downward direction.

6. The audio endpoint of claim 1, wherein the speaker waveguide comprises:

interleaved sets of fins configured to smooth pressure from a center of the speaker waveguide outward, over a broad frequency range, as the sounds output by the speaker propagate outwards in the radially outward directions.

7. An audio endpoint comprising:

a base plate configured to support the audio endpoint on a support surface;

a speaker assembly including:

a speaker configured to emit sounds towards the base plate; and a speaker waveguide disposed between the speaker and the base plate and configured to propagate sound emitted from the speaker in radial outward directions, away from the audio endpoint; and a microphone assembly disposed between the speaker assembly and the baseplate, wherein the microphone assembly is vibrationally and acoustically isolated from the speaker assembly.

8. The audio endpoint of claim 7, wherein the speaker waveguide comprises:

interleaved sets of fins configured to smooth pressure from a center of the speaker waveguide outward, over a broad frequency range, as the sound emitted from the speaker propagates outward in the radial outward directions.

9. The audio endpoint of claim 7, wherein the microphone assembly includes two or more microphones that are each positioned to pick up sound in a direction that is perpendicular to the one of the radially outward directions in which the sound emitted from the speaker is propagated.

10. The audio endpoint of claim 7, wherein the microphone assembly comprises:

a plurality of microphones embedded within a microphone wave guide that is separated from the speaker waveguide by a gap of approximately 2 mm.

11. The audio endpoint of claim 10, wherein the microphone waveguide comprises:

microphone receptacles that are each configured to receive one of the plurality of microphones, wherein the microphone receptacles create impedance pockets on either side of each of the plurality of microphones.

12. The audio endpoint of claim 7, wherein the speaker assembly is coupled to the microphone assembly via the base plate to vibrationally isolate the microphone assembly with respect to the speaker assembly.

13. An audio endpoint comprising:

a base plate configured to support the audio endpoint;

a speaker assembly including a speaker that emits sounds towards the base plate; and a microphone assembly, including:

a microphone waveguide that is disposed between the speaker and the baseplate and includes a plurality of graduated microphone pockets; and a plurality of microphones, each of which is positioned at the bottom of one of the graduated microphone pockets in an orientation that allows each of the plurality of microphones to pick up sound from directions that are approximately tangent to an outer circumference of the microphone waveguide, wherein the graduated microphone pockets create impedance pockets on opposite sides of each of the plurality of microphones.

14. The audio endpoint of claim 13, wherein the microphone waveguide and the speaker assembly are individually coupled to the baseplate via vibrational dampening grommets.

15. The audio endpoint of claim 13, wherein the plurality of microphones are approximately 4 mm away from a support surface on which the base plate is resting.

16. The audio endpoint of claim 13, wherein the plurality microphones includes three microphones that are equally spaced around a reference circle that is disposed within and concentric to the outer circumference.

17. The audio endpoint of claim 16, wherein the reference circle is coaxial to a central vertical axis of the speaker assembly.

18. The audio endpoint of claim 13, wherein the plurality of microphones further comprise:

a vibration dampening microphone boot casing that substantially encircles one of the plurality of microphones.

19. The audio endpoint of claim 13, wherein the plurality of microphones are bidirectional electret condenser microphones.

20. The audio endpoint of claim 13, wherein the speaker assembly further comprises:

a speaker waveguide disposed between the speaker and the base plate and configured to guide the sounds emitted by the speaker in radially outward directions.

* * * * *